US005127464A

United States Patent [19]

Butler et al.

[11] Patent Number: 5,127,464

[45] Date of Patent: Jul. 7, 1992

[54] THERMOSTAT PROVIDING ELECTRICAL ISOLATION THEREIN BETWEEN CONNECTED HEATING AND COOLING TRANSFORMERS

[75] Inventors: William P. Butler, St. Louis; Bartholomew L. Toth, Crestwood, both of Mo.

[73] Assignee: Emerson Electric Co., St. Louis, Mo.

[21] Appl. No.: 669,602

[22] Filed: Mar. 14, 1991

[51] Int. Cl.[5] ..... F25B 29/00; H02J 9/06

[52] U.S. Cl. ..... 165/14; 165/12; 165/26; 165/27; 307/64; 307/83; 236/46 R

[58] Field of Search ..... 165/12, 26, 27, 14; 236/46 R; 307/64, 83

[56] References Cited

U.S. PATENT DOCUMENTS

| | | | |
|---|---|---|---|
| 2,871,373 | 1/1959 | Malsbary et al. | 307/83 |
| 3,201,592 | 8/1965 | Reinert et al. | 307/64 |
| 3,646,355 | 2/1972 | Ireland et al. | 307/64 |
| 4,308,991 | 1/1982 | Pienetti et al. | 236/46 R |
| 4,725,001 | 2/1988 | Carney et al. | 165/12 |
| 4,898,229 | 2/1990 | Brown et al. | 165/26 |
| 5,029,285 | 7/1991 | Bobry | 307/83 |

FOREIGN PATENT DOCUMENTS

| | | | |
|---|---|---|---|
| 9006478 | 6/1990 | World Int. Prop. O. | 165/12 |

*Primary Examiner*—John K. Ford
*Attorney, Agent, or Firm*—Paul A. Becker, Sr.

[57] ABSTRACT

A low voltage space thermostat adaptable for controlling a heating-only apparatus or a heating and cooling apparatus. The thermostat includes a DC power supply and a voltage step-up transformer having two primary windings and a secondary winding for supplying electrical power to the DC power supply when there is a demand for heating, cooling, or fan operation. The thermostat also includes circuit means for supplying electrical power to the DC power supply when there is no demand for heating, cooling, or fan operation. The thermostat further includes circuit means, responsive to the existence of electrical power at a particular one of its wiring terminals, for providing electrical isolation, from each other within the thermostat, of two transformers incorporated in a two-transformer heating and cooling apparatus.

6 Claims, 2 Drawing Sheets

THERMOSTAT PROVIDING ELECTRICAL ISOLATION THEREIN BETWEEN CONNECTED HEATING AND COOLING TRANSFORMERS

BACKGROUND OF THE INVENTION

This invention relates to low-voltage space thermostats which control operation of heating-only systems and of heating and cooling systems.

U.S. Pat. No. 4,898,229 shows an electronic thermostat adaptable for use with a single-transformer or a two-transformer power source in a heating and cooling system. A single-transformer power source results in a system having four wires connected to the thermostat; a two-transformer power source results in a system having five wires connected to the thermostat. A disadvantage of this referenced thermostat is that it has only four wiring terminals. Specifically, when the installer of this referenced thermostat encounters the condition wherein the existing wiring to the thermostat location consists of five wires, he may not be sure as to how to properly connect the five wires to the four wiring terminals. The installer may conclude that the four-terminal thermostat is simply not the proper thermostat for use with five wires and return the thermostat to the seller, thus resulting in inconvenience, expensive service calls, and/or loss of sales.

It is desired to improve the referenced thermostat by providing five wiring terminals instead of four. The basic concept of a five-terminal thermostat being adaptable for use in a single-transformer (four connecting wires) or a two-transformer (five connecting wires) system has been known for many years. Such a five-terminal thermostat is shown in U.S. Pat. No. 4,308,991. Briefly, in such a construction, two of the thermostat terminals are connected together at the terminals by a removable wire jumper. When the heating and cooling system uses a single transformer, the wire jumper is retained, and one end of the secondary winding of the single transformer is connected to one of the two jumper-connected terminals. The other end of the secondary winding is connected through a fan relay, gas valve, and contactor to the remaining three terminals. When the heating and cooling system uses two transformers, the wire jumper is removed, and one end of the secondary winding of one of the transformers is connected to one of the two terminals previously connected by the wire jumper, and one end of the secondary winding of the other transformer is connected to the other of the two terminals previously connected by the wire jumper. The other end of the secondary winding of one of the transformers is connected through the gas valve to one of the three remaining terminals, and the other end of the secondary winding of the other transformer is connected through the fan relay and contactor to the remaining two terminals. Apparently, the five-terminal construction is sufficiently well known, especially by professional installers, so that no particular confusion exists when connecting such a five-terminal thermostat to either four or five wires.

The thermostat shown in U.S. Pat. No. 4,308,991 uses a mechanical system selector switch which provides for electrical isolation of the two transformers, from each other, in a two-transformer heating and cooling system. The thermostat shown in U.S. Pat. No. 4,898,229, of which the thermostat of the present invention is an improvement, uses electronic means rather than a mechanical switch, to effect the system selector function, and furthermore, embodies a common terminal to which both transformers are connected. It is noted that a modified construction of the thermostat shown in U.S. Pat. No. 4,898,229, such modified construction being described at column 8, line 53 through column 9, line 36 therein, provides for a five-terminal construction wherein electrically operated means is provided for effecting the system selector switch function, and the two transformers are electrically isolated from each other. However, such construction requires the addition of a relay which is relatively expensive.

SUMMARY OF THE INVENTION

An object of this invention is to provide a generally new and improved five-terminal electronic thermostat adaptable for use in a single-transformer or two-transformer heating and cooling system.

A further object of this invention is to provide such a thermostat embodying a power supply including a voltage step-up transformer having a first primary winding in the heating system circuit, a second primary winding in the cooling system circuit, and a single secondary winding.

A further object of this invention is to provide such a thermostat which includes circuit means therein for electrically isolating two transformers in a two-transformer heating and cooling system.

A further object of this invention is to provide such a thermostat which is also adaptable for use in a heating-only system.

The above-mentioned and other objects and features of the present invention will become apparent from the following description when read in conjunction with the accompanying drawings.

DESCRIPTION OF THE PREFERRED EMBODIMENT

Figure 1:
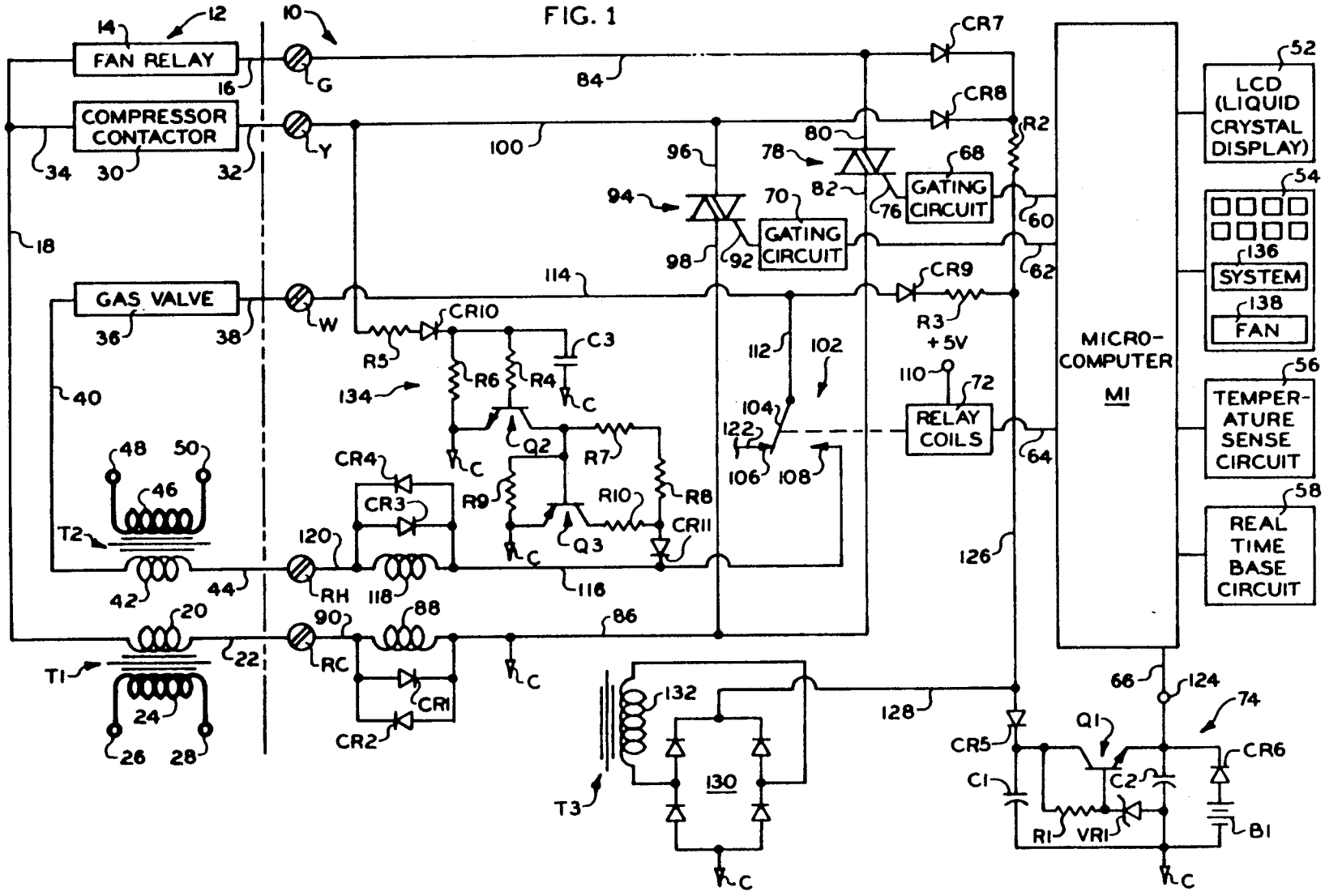
FIG. 1 is a schematic illustration, largely in block form, of a thermostat incorporating the present invention and shown connected to a two-transformer heating and cooling system.

Referring to FIG. 1, shown generally at 10 is a programmable electronic thermostat for controlling operation of heating and cooling apparatus shown generally at 12. Thermostat 10 is provided with screw terminals G, Y, W, RH and RC to which the heating and cooling apparatus 12 is connected.

Heating and cooling apparatus 12 includes a fan relay 14 which is connected by a lead 16 to terminal G and by a lead 18 to one end of the low voltage secondary winding 20 of a first voltage step-down transformer T1. The other end of secondary winding 20 is connected by a lead 22 to terminal RC. The primary winding 24 of transformer T1 is connected across terminals 26 and 28 of a conventional 120 volt alternating current power source.

Apparatus 12 further includes a compressor contactor 30 which is connected by a lead 32 to terminal Y and by a lead 34 and lead 18 to one end of secondary winding 20 of transformer T1.

Apparatus 12 further includes a gas valve 36 which is connected by a lead 38 to terminal W and by a lead 40 to one end of the low voltage secondary winding 42 of a second voltage step-down transformer T2. The other end of secondary winding 42 is connected by a lead 44 to terminal RH. The primary winding 46 of transformer T2 is connected across terminals 48 and 50 of a conventional 120 volt alternating current power source. It is noted that the primary windings 24 and 46 of transformers T1 and T2, respectively, can be connected across the same 120 volt alternating current power source rather than across separate sources as shown.

While thermostat 10 may take many forms in embodying the invention, a preferred construction is shown in the drawing. For brevity, only those features believed necessary or helpful to enable understanding of the present invention are shown and hereinafter described.

Thermostat 10 includes a programmable microcomputer M1. In the preferred embodiment, microcomputer MI is an NEC μPD7503, which is a CMOS 4-bit single chip device and which includes an ALU (arithmetic logic unit), an accumulator, a 4096×8-bit ROM (read only memory), a 224×4-bit RAM (random access read/write memory), an 8-bit timer/event counter, a display controller/driver, and 23 I/O (input/output) lines.

Connected to microcomputer M1 are an LCD 52 (liquid crystal display), a keypad 54, a temperature sense circuit 56, and a real time base circuit 58.

LCD 52 provides a plurality of display elements for designating time and temperature plus various other information. Keypad 54 comprises a matrix switch having individual keys which enable the user to program microcomputer M1 so as to provide a desired time-temperature schedule of operation of thermostat 10. Temperature sense circuit 56 includes a thermistor (not shown) in circuit with an oscillator (not shown), the output frequency of which is a function of the ambient temperature sensed by the thermistor. This frequency is measured by microcomputer M1 and converted to a measurement of degrees of temperature. Real time base circuit 58 includes a crystal oscillator (not shown) and provides an accurate time base for all real time functions.

Connected to microcomputer M1 by leads 60, 62, 64, and 66 are a gating circuit 68, a gating circuit 70, relay coils 72, and a DC power supply 74, respectively.

Gating circuit 68 is connected to the gate 76 of a controlled solid state switch comprising a triac 78 having main terminals 80 and 82. Main terminal 80 is connected to terminal G by a lead 84. Main terminal 82 is connected to terminal RC through a lead 86, a first primary winding 88 of a voltage step-up transformer T3, and a lead 90. A pair of rectifiers CR1 and CR2 are connected in opposite polarity across first primary winding 88. Lead 86 is connected to chassis common C.

Gating circuit 70 is connected to the gate 92 of a controlled solid state switch comprising a triac 94 having main terminals 96 and 98. Main terminal 96 is connected to terminal Y by a lead 100. Main terminal 98 is connected to terminal RC through lead 86, first primary winding 88, and lead 90.

Relay coils 72 comprise a pair of coils in a latching relay 102 having a movable contact 104 and a pair of fixed contacts 106 and 108. The relay coils 72 are connected at 110 to a 5 volt source provided by DC power supply 74. Movable contact 104 is connected to terminal W by leads 112 and 114. Fixed contact 108 is connected to terminal RH through a lead 116, a second primary winding 118 of transformer T3, and a lead 120. A pair of rectifiers CR3 and CR4 are connected in opposite polarity across second primary winding 118. Fixed contact 106 is connected to additional circuitry (not shown) by a lead 122.

DC power supply 74 is effective to provide a continuous voltage of approximately 5 volts at an output terminal 124 which is connected to microcomputer M1 by lead 66. DC power supply 74 includes an NPN transistor Q1 having its emitter connected to terminal 124 and its collector to the cathode of a rectifier CR5. A current limiting resistor R1 is connected between the collector and base of transistor Q1. A capacitor C1 is connected between the collector of transistor Q1 and chassis common C. A voltage regulator VR1 is connected between the base of transistor Q1 and common C. A capacitor C2 is connected between the emitter of transistor Q1 and common C. A battery power source B1, comprising three 1.5 volt alkaline batteries, is connected in series with a rectifier CR6 between terminal 124 and common C. Battery power source B1 is effective to provide sufficient power to maintain program memory and clock function in microcomputer M1 in the event of a lengthy electrical power interruption.

DC power supply 74 is connected to terminal G through a lead 126, a dropping resistor R2, a rectifier CR7, and lead 84; to terminal Y through lead 126, resistor R2, a rectifier CR8, and lead 100; and to terminal W through lead 126, a dropping resistor R3, a rectifier CR9, and lead 114. DC power supply 74 is also connected, through a lead 128 and a full-wave bridge circuit 130, to the secondary winding 132 of transformer T3. Bridge circuit 130 is connected to chassis common C.

Shown generally at 134 is a circuit including controlled solid state switching means comprising an NPN transistor Q2 and a PNP transistor Q3. The base of transistor Q2 is connected to lead 100 through a resistor R4, a rectifier CR10, and a resistor R5. The emitter of transistor Q2 is connected to chassis common C. A resistor R6 is connected between the cathode of rectifier CR10 and the emitter of transistor Q2. A filter capacitor C3 is connected between the cathode of rectifier CR10 and chassis common C. The base of transistor Q3 is connected to the collector of transistor Q2 which is connected to lead 116 through a resistor R7, a resistor R8, and a rectifier CR11. The emitter of transistor Q3 is connected to chassis common C. A resistor R9 is connected between the base and emitter of transistor Q3. A resistor R10 is connected between the collector of transistor Q3 and the anode of rectifier CR11.

As will hereinafter be described in more detail, circuit 134 is provided so as to enable secondary winding 42 of transformer T1 to supply electrical power to DC power supply 74 in the event transformer T1 is either not provided, such as in a heating-only system, or in the event transformer T1 is de-energized, such as by disconnecting electrical power to transformer T1 during the heating season. Whenever transformers T1 and T2 are provided and are electrically energized, circuit 134 electrically isolates from each other, within thermostat 10, the secondary windings 20 and 42 of transformers T1 and T2, respectively.

Operation of thermostat 10 is controlled by a set of instructions programmed into the ROM of microcomputer M1, and by information entered into the RAM of microcomputer M1 by the user by means of keypad 54. By proper entry of information, the user can establish a desired time-temperature schedule for controlling heating and cooling apparatus 12. Typical apparatus and method for establishing such a desired time-temperature schedule is shown in U.S. Pat. No. 4,308,991.

In thermostat 10, the system selector switch, designated at 136, is a key in keypad 54 and is operable to provide a HEAT mode, a COOL mode, an OFF mode, and an AUTO mode. In the HEAT mode, the thermostat 10 is effective to control the heating apparatus so as to maintain the space temperature at the selected heating set point temperature value. In the COOL mode, thermostat 10 is effective to control the cooling apparatus so as to maintain the space temperature at the selected cooling set point temperature value. In the OFF mode, thermostat 10 prevents energizing of compressor contactor 30 and gas valve 36. In the AUTO mode, thermostat 10 is effective to maintain the space temperature between two user-selected set point temperature values by automatically actuating the heating apparatus or the cooling apparatus, whichever is required to maintain the space temperature between the two values. For example, if the two values are 70° F. and 75° F., thermostat 10 will automatically actuate the heating apparatus when the space temperature drops below 70° F. and will automatically actuate the cooling apparatus when the space temperature rises above 75° F.

In thermostat 10, the fan switch, designated at 138, is also a key in keypad 54. Fan switch 138 is operable to provide an AUTO mode, wherein the fan relay 14 is energized whenever the compressor contactor 30 is energized, and an ON mode, wherein the fan relay 14 is continuously energized. Fan switch 138 is also operable, by proper programming by the user and with fan switch 138 in the AUTO position after programming, to cause the fan relay 14 to be continuously energized during a specific time period.

With system selector switch 136 in the HEAT mode position, thermostat 10 provides an enabling signal on lead 64 whenever it senses, by means of temperature sense circuit 56, that heating is required. The enabling signal on lead 64 effects energizing of one of the latching relay coils 72 so as to cause movable relay contact 104 to make contact with fixed contact 108. With contact 108 made, gas valve 36 is energized by the secondary winding 42 of transformer T2. When the heating requirement is satisfied, an enabling signal is provided on lead 64 to effect energizing of the other of the latching relay coils 72 so as to cause relay contact 104 to break contact with contact 108. With contact 108 open, gas valve 36 is de-energized.

With system selector switch 136 in the COOL mode position, thermostat 10 provides an enabling signal on lead 62 whenever it senses that cooling is required. The enabling signal on lead 62 effects, through gating circuit 70, conduction of triac 94. With triac 94 conducting, compressor contactor 30 is energized by the secondary winding 20 of transformer T1. When the cooling requirement is satisfied, the enabling signal on lead 62 no longer appears, and triac 94 becomes non-conductive.

With system selector switch 136 in the AUTO mode position, thermostat 10 provides an enabling signal on lead 64 whenever heating is required and an enabling signal on lead 62 whenever cooling is required.

Whenever energizing of the fan relay 14 is required, thermostat 10 provides an enabling signal on lead 60. The enabling signal on lead 60 effects, through gating circuit 68, conduction of triac 78. With triac 78 conducting, fan relay 14 is energized by the secondary winding 20 of transformer T1. When energizing of the fan relay 14 is not required, an enabling signal does not appear on lead 60, and triac 78 is non-conductive.

Referring to circuit 134, so long as secondary winding 20 of transformer T1 is electrically energized, transistor Q2 is biased on, the circuit being: from secondary winding 20, through leads 18 and 34, compressor contactor 30, leads 32 and 100, resistor R5, rectifier CR10, resistor R4, the base-emitter of transistor Q2, common C of circuit 134, common C at lead 86, first primary winding 88 of transformer T3, and leads 90 and 22 back to secondary winding 20. Capacitor C3 is effective to maintain the on-biasing of transistor Q2 during the half-cycle when rectifier CR10 is non-conductive. Transistor Q2 being biased on effectively causes the base of transistor Q3 to be at common C potential. Since the emitter of transistor Q3 is also at common C potential, transistor Q3 is prevented from being biased on. When transistor Q3 is in the non-conductive condition, it prevents common C, which exists on its emitter, from being connected to secondary winding 42 of transformer T2.

When there is no demand for heating, cooling, or fan operation, triacs 78 and 94 are non-conductive and relay contacts 104 and 108 are not made. Under this condition, electrical power to DC power supply 74 is supplied by secondary winding 20 of transformer T1 through two circuits. Specifically, secondary winding 20 provides electrical power through a first circuit comprising: from secondary winding 20, through lead 18, fan relay 14, leads 16 and 84, rectifier CR7, resistor R2, lead 126, power supply 74, common C of power supply 74, common C at lead 86, first primary winding 88 of transformer T3, and leads 90 and 22 back to secondary winding 20. The second circuit comprises: from secondary winding 20, through leads 18 and 34, compressor contactor 30, leads 32 and 100, rectifier CR8, resistor R2, lead 126, power supply 74, common C of power supply 74, common C at lead 86, first primary winding 88, and leads 90 and 22 back to secondary winding 20. The two circuits supply sufficient electrical power to power supply 74 to enable power supply 74 to provide a 5 volt power source to microcomputer M1 at terminal 124. The resistance values of resistors R2 and R3 are sufficiently high so as to prevent fan relay 14 and compressor contactor 30 from being energized. Because transistor Q3 in circuit 134 is non-conductive, a circuit connection through common C of circuit 134 to secondary winding 42 of transformer T2 is prevented. Thus, under this condition, secondary windings 20 and 42 of transformers T1 and T2, respectively, are electrically isolated from each other within thermostat 10.

When there is a demand for heating, electrical power to DC power supply 74 is supplied by secondary winding 132 of transformer T3. Specifically, when relay contacts 104 and 108 are made, a circuit is completed from secondary winding 42 of transformer T2, through lead 40, gas valve 36, leads 38, 114, and 112, contacts 104 and 108, lead 116, second primary winding 118 of transformer T3, and leads 120 and 44 back to secondary winding 42. Sufficient current flows through second primary winding 118 of transformer T3 to effect the values of voltage and current in the secondary winding 132 of transformer T3 required to supply electrical power to power supply 74 whereby power supply 74 is effective to provide a 5 volt power source to microcomputer M1 at terminal 124. The circuit connection between secondary winding 132 and power supply 74 comprises: from secondary winding 132, through a portion of bridge circuit 130, lead 128, power supply 74, common C of power supply 74, common C at bridge circuit 130, and another portion of bridge circuit 130 back to secondary winding 132. The impedance of second primary winding 118 is relatively small in comparison to the impedance of gas valve 36. Therefore, the voltage drop across second primary winding 118 is also relatively small so that sufficient voltage appears across gas valve 36 to effect proper energizing thereof. Rectifiers CR3 and CR4, which limit the voltage drop across second primary winding 118 to approximately 0.6 volts, further ensure that such sufficient voltage will be provided.

When there is a demand for cooling, triac 94 is conductive and a circuit is completed from secondary winding 20 of transformer T1, through leads 18 and 34, compressor contactor 30, leads 32 and 100, triac 94, lead 86, first primary winding 88 of transformer T3, and leads 90 and 22 back to secondary winding 20. When there is a demand for fan operation, triac 78 is conductive and a circuit is completed from secondary winding 20 of transformer T1, through lead 18, fan relay 14, leads 16 and 84, triac 78, lead 86, first primary winding 88, and leads 90 and 22 back to secondary winding 20. With first primary winding 88 of transformer T3 energized due to either a demand for cooling or a demand for fan operation, or for both, the secondary winding 132 of transformer T3 provides the required electrical power to DC power supply 74 in the same manner as that previously described relative to a demand for heating. Rectifiers CR1 and CR2 limit the voltage drop across first primary winding 88 of transformer T3 to approximately 0.6 volts to ensure sufficient voltage is available to effect energizing of compressor contactor 30 and/or fan relay 14.

It is noted that in the above-described conditions, regardless of whether or not there is a demand for heating, cooling, and/or fan operation, transistor Q3 in circuit 134 is non-conductive. With transistor Q3 non-conductive, a circuit connection through common C of circuit 134 to secondary winding 42 of transformer T2 is prevented so that secondary windings 20 and 42 of transformers T1 and T2, respectively, are electrically isolated from each other within thermostat 10.

Figure 2:
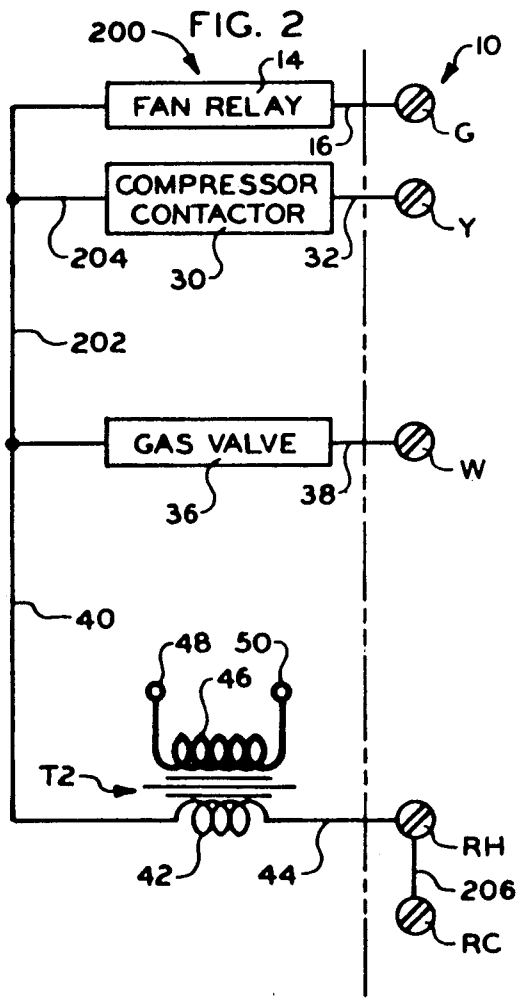
FIG. 2 is a partial illustration showing the thermostat of FIG. 1 connected to a single-transformer heating and cooling system.

Thermostat 10 is also adaptable for use in a heating and cooling system which utilizes a single-transformer power source. Specifically, referring to FIG. 2, shown therein is a heating and cooling apparatus 200. The same reference numbers used in FIG. 1 are used in FIG. 2 for like components and circuit connections. Apparatus 200 is the same as apparatus 12 of FIG. 1 except transformer T1 is omitted and the secondary winding 42 of transformer T2 is connected to fan relay 14 by lead 40 and a lead 202, and to compressor contactor 30 by lead 40, lead 202, and a lead 204. Fan relay 14, compressor contactor 30, and gas valve 36 are connected to terminals G, Y, and W, respectively, in the same manner as in FIG. 1. In thermostat 10, a wire jumper 206 is connected between terminals RH and RC. Since electrical power is applied to terminal Y, transistor Q2 in circuit 134 is biased on and transistor Q3 is biased off. Under this condition, circuit 134 provides no useful isolating function since there is only one secondary winding, winding 42, in the power source. It is noted that under this condition, the secondary winding 42 of the single-transformer power source provides the power source for DC power supply 74 in a manner similar to that provided by the previously-described secondary windings 20 and 42. One difference in the manner of operation is that when there is no demand for heating, cooling, or fan operation, there is a circuit through gas valve 36 to DC power supply 74 in addition to the previously-described circuits through fan relay 14 and compressor contactor 30. The additional circuit exists because wire jumper 206 between terminals RC and RH connects common C at lead 86 to the secondary winding 42 of the single-transformer power source.

Figure 3:
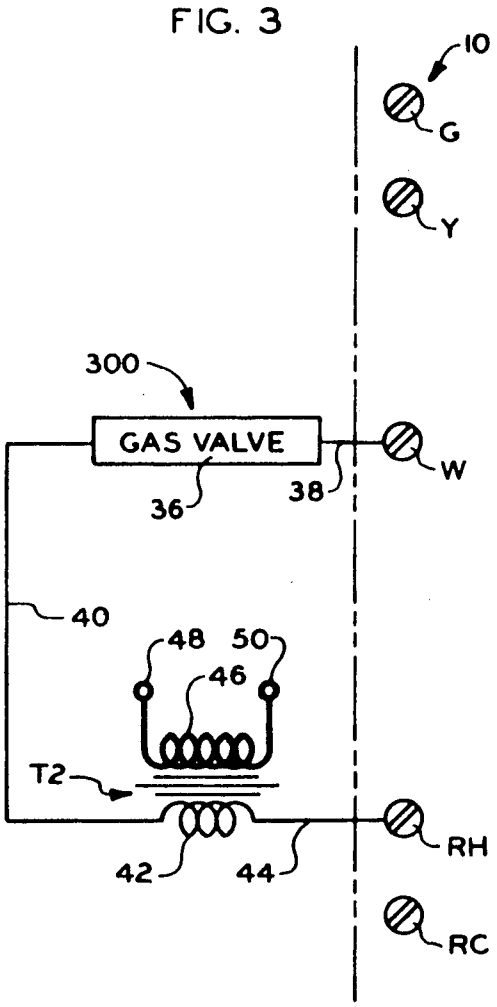
FIG. 3 is a partial illustration showing the thermostat of FIG. 1 connected to a heating-only system.

The only condition which can cause transistor Q3 to be conductive is when there is no electrical power applied to terminal Y. This condition could exist, for example, if there is no cooling apparatus provided, that is to say, if the apparatus to be controlled by thermostat 10 is a heating-only apparatus wherein transformer T1, fan relay 14, and compressor contactor 30 would not be provided. Such a heating-only apparatus is shown generally at 300 in FIG. 3. The same reference numbers used in FIG. 1 are used in FIG. 3 for like components and circuit connections. As another example, this condition could exist, in reference to FIG. 1, if transformer T1 were de-energized such as by opening the circuit to primary winding 24 or secondary winding 20 of transformer T1 during the heating season. In either case, when there is no electrical power at terminal Y, there is no energizing circuit to the biasing circuit of transistor Q2. Transistor Q2 is therefore non-conductive. Under this condition, when there is no demand for heating, electrical power to DC power supply 74 is supplied by secondary winding 42 of transformer T2 through a circuit comprising: from secondary winding 42, through lead 40, gas valve 36, leads 38 and 114, rectifier CR9, resistor R3, lead 126, power supply 74, common C of power supply 74, common C at the emitter of transistor Q3, the emitter-collector of transistor Q3, resistor R10, rectifier CR11, lead 116, second primary winding 118 of transformer T3, and leads 120 and 44 back to secondary winding 42. It is noted that, with transistor Q2 off, transistor Q3 is biased to its conductive state through its base-emitter circuit and resistors R7 and R8 and rectifier CR11. When there is a demand for heating, second primary winding 118 and secondary winding 132 of transformer T3 cooperate to provide electrical power to DC power supply 74 in the same manner as previously described.

Therefore, under the condition of no electrical power being applied to terminal Y, there is a circuit connection through common C of circuit 134 to secondary winding 42 of transformer T2. Under this condition, therefore, circuit 134 provides a means to provide electrical power to DC power supply 74 when there is no demand for heating. It is noted that under this condition, circuit 134 does not provide an isolating function. However, since under this condition, transformer T1 is either not provided or is electrically de-energized, the issue of electrical isolation of secondary windings 20 and 42 of transformers T1 and T2, respectively, does not exist.

While it is preferable that circuit 134 be connected between terminal Y and lead 116 as shown in FIG. 1, it could be connected instead between terminal W and lead 86. If it were so connected, common C would be connected to lead 116 instead of to lead 86. The connection shown in FIG. 1 is preferable because it allows only one situation to arise wherein current can flow through gas valve 36 when energizing of gas valve 36 is not intended. Specifically, it is only with the heating-only arrangement of FIG. 3 in which, when there is no demand for heating, a current not intended for energizing gas valve 36 flows through gas valve 36. As previously described, such current flow provides electrical power to DC power supply 74. Such current flow is limited by resistor R10 in circuit 134 and is insufficient to effect energizing of gas valve 36. If circuit 134 were connected between terminal W and lead 86 and common C were connected to lead 116 instead of to lead 86, current would flow through gas valve 36 at all times so long as transformer T2 is electrically energized. Specifically, current would flow through gas valve 36 through resistor R5, rectifier CR10, resistor R6, and the common C connections at circuit 134 and lead 116. Again, such current flow would be insufficient to effect energizing of gas valve 36. However, since gas valve 36 is typically an electromagnetic device sensitive to some degree to constant energizing, particularly by a unidirectional current, it is preferable that such energizing of gas valve 36 be minimized. It is noted that, generally, compressor contactors are considerably less sensitive than gas valves to such constant energizing.

It is also noted that it is not essential that fan relay 14 be connected to DC power supply 74. Rectifier CR7 can be omitted, leaving the function of supplying electrical power to DC power supply 74, when there is no demand for heating, cooling, or fan operation, to the circuit connected through compressor contactor 30.

While the invention has been illustrated and described in detail in the drawing and foregoing description, it will be recognized that many changes and modifications will occur to those skilled in the art. It is therefore intended, by the appended claims, to cover any such changes and modifications as fall within the true spirit and scope of the invention.

We claim:

1. In a thermostat adaptable for controlling operation of heating and cooling apparatus, which apparatus comprises a first transformer effective to supply electrical power through said thermostat to effect a heating function and a second transformed effective to supply electrical power through said thermostat to effect a cooling function, circuit means therein responsive to the energized state of one of said transformers for providing electrical isolation of said transformers from each other within said thermostat, said thermostat further including a DC power supply and a voltage step-up transformer having two primary windings and a secondary winding, one of said two primary windings being connected in series with said first transformer, the other one of said two primary windings being connected in series with said second transformer, and said secondary winding being connected to said DC power supply.

2. The thermostat claimed in claim 1 wherein said thermostat further includes circuit means for supplying electrical power to said DC power supply when there is no demand for said heating and cooling functions, said last mentioned circuit means supplying power from said second transformer when said second transformer is energized and from said first transformer when said second transformer is de-energized.

3. In a thermostat adaptable for controlling operation of heating-only apparatus and of heating and cooling apparatus, a plurality of wiring terminals within the thermostat, a first one of said wiring terminals being adaptable to be connected to the secondary winding of a single transformer in a single-transformer heating and cooling apparatus or in the heating-only apparatus or to the secondary winding of a first transformer in a two-transformer heating and cooling apparatus, a second one of said wiring terminals being adaptable to be connected to the secondary winding of a second transformer in said two-transformer heating and cooling apparatus or to said first one of said wiring terminals when said first one of said wiring terminals is connected to said secondary winding of said single transformer in said single-transformer heating and cooling apparatus, third, fourth, and fifth ones of said wiring terminals being adaptable to be connected to low-voltage operated devices in said heating and cooling apparatus or in said heating-only apparatus;

first switching means connected between said first one and said third one of said wiring terminals for controlling energizing of said low-voltage operated devices to effect a heating function;

second switching means connected between said second one and said fourth one of said wiring terminals for controlling energizing of said low-voltage operated devices to effect a cooling function;

third switching means connected between said second one and said fifth one of said wiring terminals for controlling energizing of said low-voltage operated devices to effect a fan function;

a DC power supply within said thermostat;

first circuit means for effecting supply of electrical power to said DC power supply when one or more of said first, second, and third switching means is conductive, said first circuit means including a voltage step-up transformer having two primary windings and a secondary winding, one of said two primary windings being connected in series with said first switching means to said first one of said wiring terminals, the other one of said two primary windings being connected in series with said second and third switching means to said second one of said wiring terminals, and said secondary winding being connected to said DC power supply;

second and third circuit means connected between said third and fourth ones of said wiring terminals, respectively, and said DC power supply, said third circuit means being effective, when electrical power is provided at said fourth one of said wiring terminals, to supply electrical power to said DC power supply when said first, second, and third switching means are non-conductive; and fourth circuit means connected between said first one and said fourth one of said wiring terminals, said fourth circuit means being effective, when said first switching means is non-conductive and electrical power is not provided at said fourth one of said wiring terminals, for enabling said second circuit means to supply electrical power to said DC power supply, and being effective, when said first switching means is non-conductive and electrical power is provided at said fourth one of said wiring terminals, for preventing said second circuit means from supplying electrical power to said DC power supply.

4. The thermostat claimed in claim 3 further including fifth circuit means connected between said fifth one of said wiring terminals and said DC power supply, said fifth circuit means being effective, when electrical power is provided at said fifth one of said wiring terminals, to supply electrical power to said DC power supply when said first, second, and third switching means are non-conductive.

5. The thermostat claimed in claim 3 wherein said DC power supply includes a common connection with said fourth circuit means, said fourth circuit means including a solid state switching means connected between said common connection and said first one of said wiring terminals, said solid state switching means being rendered non-conductive when electrical power is provided at said fourth one of said wiring terminals and being rendered conductive when electrical power is not provided at said fourth one of said wiring terminals.

6. The thermostat claimed in claim 3 wherein said DC power supply includes a common connection with said other one of said two primary windings.

* * * * *